US011668058B2

(12) United States Patent
Kloeckner

(10) Patent No.: US 11,668,058 B2
(45) Date of Patent: Jun. 6, 2023

(54) GROUND MILLING MACHINE WITH DUST REMOVAL DEVICE AND SERVICE TUNNEL AND METHOD

(71) Applicant: BOMAG GMBH, Boppard (DE)

(72) Inventor: Stefan Kloeckner, Boppard (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 17/447,814

(22) Filed: Sep. 16, 2021

(65) Prior Publication Data

US 2022/0081853 A1 Mar. 17, 2022

(30) Foreign Application Priority Data

Sep. 16, 2020 (DE) ..... 10 2020 005 666.0

(51) Int. Cl.
*E01C 23/088* (2006.01)
*E01C 23/12* (2006.01)
*E21C 35/22* (2006.01)

(52) U.S. Cl.
CPC ..... *E01C 23/088* (2013.01); *E01C 23/127* (2013.01); *E01C 2301/50* (2013.01); *E21C 35/223* (2013.01)

(58) Field of Classification Search
CPC .. E01C 23/088; E01C 23/127; E01C 2301/50; E21C 35/223; B08B 15/02
See application file for complete search history.

(56) References Cited

U.S. PATENT DOCUMENTS 5,079,404 A 1/1992 Zamuner
7,219,964 B2 5/2007 Berning et al.
(Continued)

FOREIGN PATENT DOCUMENTS

CN 104428468 3/2015
CN 204551186 8/2015
(Continued)

OTHER PUBLICATIONS

First Office Action from related Chinese Appln. No. 202111048712.7 dated Nov. 16, 2022. English translation attached.

*Primary Examiner* — Janine M Kreck
*Assistant Examiner* — Michael A Goodwin
(74) *Attorney, Agent, or Firm* — Grossman, Tucker, Perreault & Pfleger, PLLC

(57) ABSTRACT

A ground milling machine, comprising a milling drum, rotatably mounted in a milling-drum housing, for removing ground material, a milled-material conveying apparatus for transporting the removed ground material and a dust extraction apparatus for extracting dust-containing air from a region of the milled-material conveying apparatus, the dust extraction apparatus comprising at least one extraction line, which opens into the region of the milled-material conveying apparatus via an extraction opening, the ground milling machine comprising a left side wall, a right side wall, a front wall and a rear wall, and wherein a maintenance tunnel is provided which is designed such that it establishes an access connection, accessible from outside the ground milling machine, between the extraction opening and one of the side walls, the front wall or the rear wall of the ground milling machine. A method for maintenance of the dust extraction apparatus is also disclosed.

17 Claims, 5 Drawing Sheets

(56) References Cited

U.S. PATENT DOCUMENTS

| | | | | |
|---|---|---|---|---|
| 8,985,701 | B2 | 3/2015 | Denson et al. | |
| 10,309,066 | B2 | 6/2019 | Lindholm et al. | |
| 2010/0327651 | A1 | 12/2010 | Cipriani | |
| 2014/0015303 | A1* | 1/2014 | Denson | E01C 23/088 299/39.2 |
| 2016/0326870 | A1* | 11/2016 | Bjorge | E21C 35/223 |
| 2017/0350080 | A1* | 12/2017 | Hirman | B08B 9/0813 |
| 2018/0127930 | A1* | 5/2018 | Lindholm | E01C 23/088 |
| 2019/0257042 | A1* | 8/2019 | Laux | E01C 23/088 |

FOREIGN PATENT DOCUMENTS

| | | |
|---|---|---|
| CN | 203716031 | 7/2017 |
| CN | 108018767 | 5/2018 |
| CN | 108797291 | 11/2018 |
| DE | 102004007716 | 6/2005 |
| DE | 102012022879 | 10/2015 |
| EP | 0756037 | 1/1997 |
| EP | 2265765 | 3/2014 |
| EP | 3225738 | 11/2018 |
| JP | 2005305566 | 11/2005 |

* cited by examiner

Fig. 3
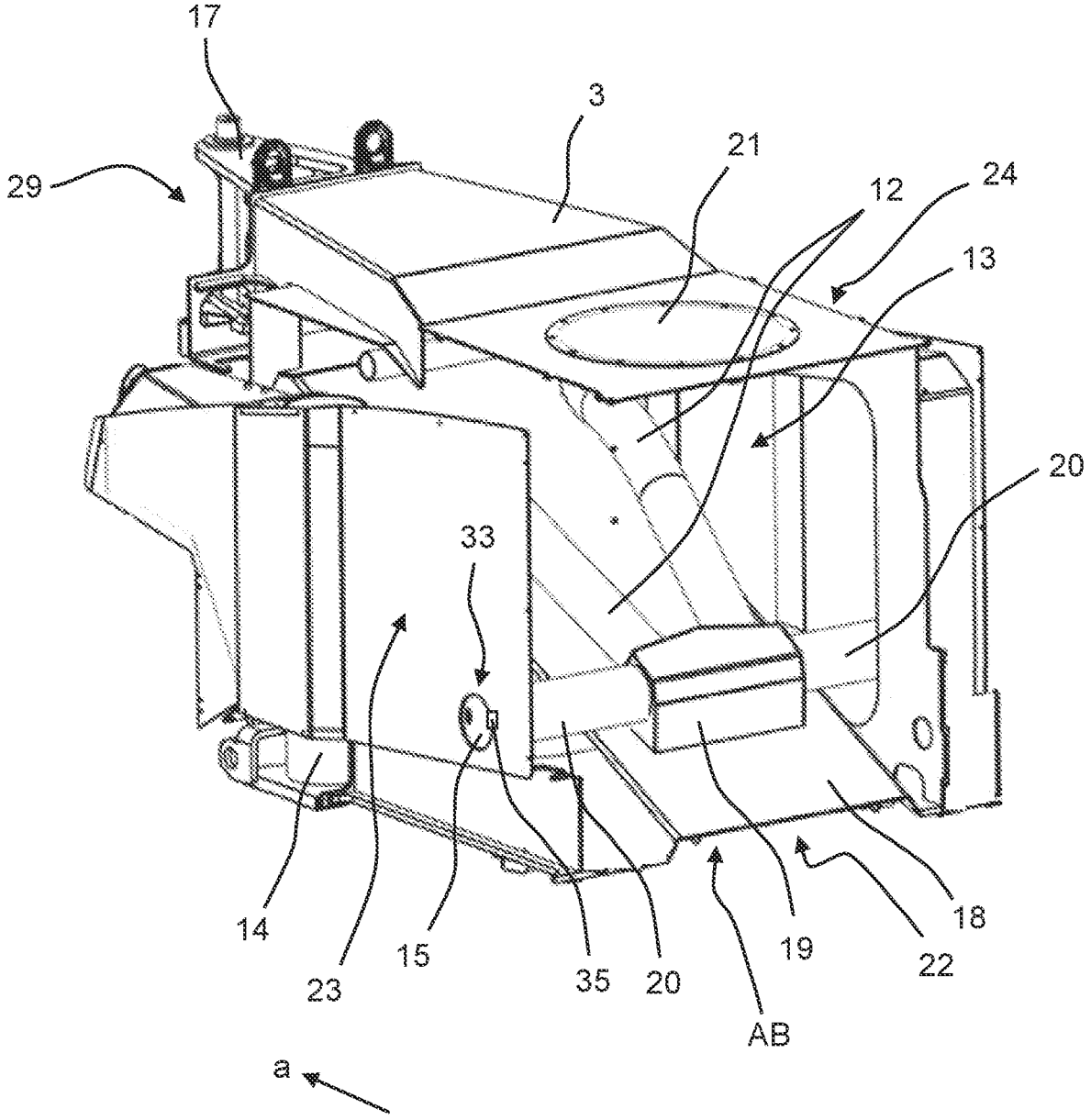
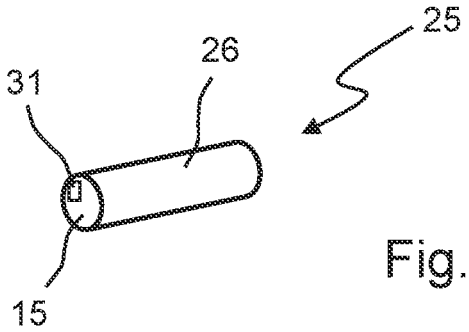
Fig. 4

GROUND MILLING MACHINE WITH DUST REMOVAL DEVICE AND SERVICE TUNNEL AND METHOD

FIELD

The invention relates to a ground milling machine, in particular a road milling machine, recycler or stabilizer, for machining ground in or counter to a working direction. Furthermore, the invention also relates to a method for the maintenance of a dust extraction apparatus for extracting dust-containing air from a milled-material conveying apparatus of a ground milling machine.

BACKGROUND

Generic ground milling machines are used in road construction. They have a machine frame, supported by travel apparatuses, comprising a drive engine. The travel apparatuses may for example be crawler tracks or wheels in this case. The drive engine is typically an internal combustion engine, for example a diesel internal combustion engine. Machines of this kind are generally self-propelled and move over the surface of the ground to be machined of their own accord. The central working apparatus of generic ground milling machines is a milling drum, rotatably mounted in a milling-drum housing arranged on the machine frame, for removing ground material. The milling drum is usually a hollow-cylindrical steel structure, on the outer lateral surface of which a plurality of milling tools, for example milling picks, are mounted. During the work operation, the milling drum is rotated about a rotational axis, which usually extends horizontally and transversely to the working direction of the ground milling machine, and the milling tools are driven into the ground to be removed, as a result of which this ground is milled off to a milling depth. The milling-drum housing surrounds the milling drum in a hood-like manner and is open towards the ground. The removed ground material that is swirled around in the milling-drum housing is typically loaded onto a milled-material conveying apparatus for transport from the milling-drum housing to a discharge point. At the discharge point of the milled-material conveying apparatus, it discharges this ground material onto the load bed of a transport vehicle, for example a truck.

Milling off and transporting the ground material can result in a large amount of dust being formed. In order to keep the discharge of dust into the external environment around the ground milling machine as low as possible, it is known to provide a dust extraction apparatus for extracting dust-containing air from a region of the milled-material conveying apparatus. The dust extraction apparatus typically comprises at least one suction fan and one extraction line, which opens into a region, the extraction region, of the milled-material conveying apparatus via an extraction opening. Here, the extraction opening for example establishes a connection between a conveying region, for example a conveying shaft, of the milled-material conveying apparatus and the dust extraction apparatus, for example the extraction line. The extracted dust-containing air is for example purified downstream of the extraction opening by various filter techniques, for example by cyclone filters, fabric filters and/or electrostatic filters. The dust deposited on the relevant filter apparatus can be returned to the milled material. Generic ground milling machines comprising dust extraction apparatuses are known from the additional documents DE 10 2012 022 879 B4 and EP 3 225 738 B1 by the applicant, for example.

During operation of the ground milling machine, the dust extraction apparatus may become clogged or blocked with dirt, in particular in the region of the extraction opening. In this case, the blocked regions, in particular the extraction opening, have to be cleaned, since otherwise it is no longer possible to sufficiently reduce dust. Here, the region of the extraction opening in particular describes the space at the rear in the extraction direction, but in particular also in front of the extraction opening, from which space dust-polluted air is extracted in normal operation, i.e. the space in the operating region of the extraction opening. Purely in spatial terms, this may in particular be the space immediately surrounding the extraction opening. However, due to the frequently poor access to this region from the outside, it is complex and time-consuming to clean this extraction opening. The extraction opening is thus usually arranged so as to be displaced roughly towards the center of the machine both in the horizontal and vertical direction or is not located in the outer region of the machine. In other words, the extraction opening is frequently located in the interior of the machine, when viewed from the outside. In order to reach this point, it is therefore often necessary for an operator to climb onto the ground milling machine, to open a service hatch covering a manhole, and to gain access to the blocked regions through this service hatch from above. Another challenge may be that, in order to save installation space, at least part of the dust extraction apparatus may often extend through a water tank arranged on the ground milling machine, for example in the form of extraction lines. It may therefore be the case that in particular the region comprising the extraction opening that becomes blocked particularly often extends through the water tank. In this case, the water also has to be drained from the water tank during maintenance or cleaning in order to provide access through the tank from above. All in all, the maintenance or cleaning of the dust extraction apparatus in the region of the extraction openings therefore requires more additional work and is also associated with an increased level of risk for the operator, who has to climb onto the ground milling machine and into the interior of the machine.

To aid the understanding of the following description of the invention, it is also noted at this point that, according to the definition below, the ground milling machine comprises a left side wall, a right side wall, a front wall and a rear wall. In the present case, these terms relate to the boundaries of the machine contour that extend substantially vertically, are at the sides, and lie at the front and the rear in the longitudinal direction, with a conveying apparatus, for example a discharge conveyor belt, projecting from the machine frame and being arranged on said machine frame, being explicitly excluded here. These terms thus denote the lateral outer walls of the machine or the outer surface. The above terms therefore in particular relate to the machine frame or machine body, without conveying apparatuses arranged thereon or projecting therefrom. It is unimportant here whether the corresponding walls comprise regions that do not extend vertically or extend vertically only in part, for example curves or steps. Regions of this kind are also considered parts of the corresponding walls. Here, the left side wall denotes the outer face that is to the left in the forward and/or working direction of the machine, and the right side wall denotes the outer face that is to the right in the forward and/or working direction of the machine. The front wall or front side denotes the outer surface that delimits the machine at the front in the working and/or forward direction, and the rear wall or rear side denotes the outer surface of the machine that delimits the machine at the rear counter to the working and/or forward direction. Therefore, these do not have to be planar and/or one-piece wall elements. Instead, merely the sides of the machine or its outer surfaces are defined.

SUMMARY

The object of the present invention is to provide a ground milling machine in which the maintenance of the dust extraction apparatus is simplified. Overall, the cost-effectiveness of the operation of the ground milling machine is intended to be increased as a result. Another object is to provide a simplified method for the maintenance, for example cleaning, of a dust extraction apparatus of a ground milling machine. At the same time, however, the operation of the dust extraction apparatus should not be negatively impacted.

Specifically, the object is achieved in a ground milling machine mentioned at the outset by a maintenance tunnel being provided which comprises a tunnel entrance opening and a tunnel exit opening and is designed such that, via the tunnel entrance opening, it establishes an access connection, accessible from outside the ground milling machine, between one of the side walls, the front wall or the rear wall of the ground milling machine and the extraction opening. The maintenance tunnel extends between the tunnel entrance opening and the tunnel exit opening. The maintenance tunnel may in particular also be characterized in that it comprises at least one wall portion extending around a longitudinal tunnel axis. Particularly preferably, the maintenance tunnel is formed as an elongate cavity, the only openings in which are the tunnel entrance opening and the tunnel exit opening. In particular, the tunnel entrance opening is accessible to an operator standing beside the ground milling machine from outside, in particular from a position standing beside the machines. In turn, the tunnel exit opening opens either directly into the extraction line or into an extraction hood or extraction space, which is described again later, meaning that the extraction opening, through which the air containing dust in the region of the milled-material conveying apparatus is extracted, is made accessible through the maintenance tunnel from outside the machine. This relevant region of the dust extraction apparatus comprising the extraction opening is also called the extraction region in the following. In principle, it is possible here for the maintenance tunnel to proceed from any outer side wall, for example the side walls to the right and left, the front wall or the rear wall of the ground milling machine, or for the tunnel entrance opening to be arranged on this wall. The core concept of the invention is that the operator can reach the tunnel entrance opening from outside the ground milling machine, while standing on the ground, such that they have direct access to the extraction opening and the entire region of the dust extraction apparatus comprising the extraction opening, i.e. the extraction region, via the maintenance tunnel. In this way, the operator can easily carry out maintenance work, and in particular cleaning work, on the dust extraction apparatus, in particular in the region of the extraction opening, when standing beside the ground milling machine. Specifically, from standing beside the machine, a high-pressure cleaning lance, for example, can therefore be guided through the machine to the extraction opening from outside the machine via this maintenance tunnel. In particular, it is no longer necessary to climb onto and into the machines, and this contributes to the comfort of the operator and also precludes the operator from falling from the machine. Because a separate maintenance tunnel accessible from the side is provided through which direct access to the region of the dust extraction apparatus comprising the extraction opening is made possible, it is also no longer necessary to empty a water tank in order to gain access to the extraction region of the dust extraction apparatus from above through the water tank, for example.

Here, the tunnel entrance opening may preferably be directly surrounded by the outer surface of the ground milling machine or may be flush therewith towards the outside, in particular in a closed state, as will be discussed in greater detail in the following. This is advantageous in particular in terms of aesthetics. Additionally or alternatively, it is however also possible for the tunnel entrance opening to be offset slightly inwards from the adjoining outer surface of the ground milling machine, for example in the form of a funnel; this can make it easier to thread in a cleaning instrument.

It may be provided that the extraction line of the dust extraction apparatus opens into a conveying region, for example a conveying shaft, of the milled-material conveying apparatus directly via the extraction opening. In this case, it is also advantageous for the tunnel exit opening of the maintenance tunnel to open into the extraction line close to the extraction opening. In the present case, "close to" in particular means that the tunnel exit opening is arranged no further than 30 cm, preferably no further than 20 cm, particularly preferably no further than 10 cm, from the extraction opening. According to a preferred alternative, however, it is provided that the dust extraction apparatus comprises an extraction hood which is open towards the region of the milled-material conveying apparatus, comprises the extraction opening arranged in the region of the milled-material conveying apparatus and into which both the extraction line and the maintenance tunnel open. The extraction hood is for example designed to be open towards the conveying region, for example the conveying shaft, of the milled-material conveying apparatus on its vertically lower side via the extraction opening. It therefore forms an additional cavity connected to the extraction line, into which cavity both the at least one extraction line of the dust extraction apparatus and the maintenance tunnel open. The advantage of such an extraction hood is that a comparatively large, defined extraction region can be obtained, such that particularly comprehensive dust extraction is achieved in this region of the conveying apparatus. Furthermore, more than one extraction line can open into this region of the hood, which allows for a design of the extraction apparatus that is optimized overall in terms of installation space. The extraction hood establishes a connection between the at least one extraction line, the extraction opening (and therefore a conveying region, in particular a conveying shaft, of the milled-material conveying apparatus) and the maintenance tunnel. In particular, the clear width of the extraction hood is greater than that of the extraction line. At the same time, the extraction hood is open towards the milled-material conveying apparatus via the extraction opening. Dust-containing air is therefore transported by the dust extraction apparatus of the milled-material conveying apparatus through the extraction opening into the extraction hood and from there into the extraction line. Advantageously, access is provided through the maintenance tunnel to the interior of the extraction hood and therefore to the extraction opening. If a plurality of extraction lines and/or maintenance tunnels are provided on the ground milling machine, it is preferred for all the extraction lines and/or maintenance tunnels to open into the same extraction hood. The ground milling machine therefore preferably only comprises one single extraction hood. It is also possible for the extraction hood to be provided as a separate component or to be formed by elements of the machine frame and/or a water tank.

In principle, it is sufficient for the ground milling machine to comprise one single maintenance tunnel according to the invention. Through this tunnel, an operator can easily carry out maintenance or cleaning of the milled-material conveying apparatus and in particular the extraction opening when standing beside the ground milling machine. To do this, a pressure washer is for example introduced through the maintenance tunnel, which, where necessary, can be inserted as far as the extraction hood or the extraction opening. Blockages in the extraction region of the milled-material conveying apparatus can be removed in this way. The corresponding maintenance or cleaning can then be performed from the side of the ground milling machine, for example one of the side walls, the front wall or the rear wall, on which the tunnel entrance opening is located. According to a preferred embodiment, it is provided that at least two maintenance tunnels, preferably exactly two and only two maintenance tunnels, are provided, the second maintenance tunnel establishing an access connection between the extraction opening and an additional one of the side walls, front wall or rear wall. In the present case, this means that the second maintenance tunnel is preferably arranged on a different side of the ground milling machine from the first maintenance tunnel. If, for example, the first maintenance tunnel is arranged on the left side wall, the second maintenance tunnel can be arranged on the right side wall, the front wall or the rear wall. In this way, access to the extraction opening or to the extraction region of the milled-material conveying apparatus is made possible from two different sides of the ground milling machine via the two maintenance tunnels. This facilitates the maintenance work, for example by the operator being able to clean the extraction region at two different points around the ground milling machine and by the operator being able to select those points that are more accessible to them or are in the region they are working in anyway. Furthermore, it may be the case that the extraction region of the milled-material conveying apparatus is coated with dirt such that it can only be removed with difficulty from one side. In this case, the extraction region can be cleaned from two sides in succession or even simultaneously. Stubborn blockages can also be removed in this way.

When two maintenance tunnels are provided, it is preferable for one of the two maintenance tunnels to be arranged on the left side wall and the other of the two maintenance tunnels to be arranged on the right side wall, and for the two maintenance tunnels to open into the extraction hood in particular opposite one another. It is also preferable for one of the two maintenance tunnels to be arranged with its tunnel entrance opening on the left side wall and the other of the two maintenance tunnels to be arranged with its tunnel entrance opening on the right side wall. As a result, the two maintenance tunnels open into the extraction opening, in particular the extraction hood, in particular opposite one another, which is an optimal arrangement in terms of the desired cleaning work. The side walls of the ground milling machine are particularly easily accessible from outside the machine, which is why it is preferable to arrange the maintenance tunnels on these sides. Furthermore, the path between the outer contour of the side walls and the extraction region of the milled-material conveying apparatus is typically particularly short, such that the maintenance tunnels can also be designed to be particularly short. The fact that the two maintenance tunnels open into the extraction hood opposite one another means that all the points in the extraction region are particularly easily accessible through the two maintenance tunnels. By means of the two maintenance tunnels, which open into the extraction hood in this way, all the blockages in the extraction region can therefore be removed and cleaned particularly reliably.

The maintenance tunnel, preferably all the maintenance tunnels provided, may have a range of other advantageous features. The maintenance tunnel may thus extend in a straight line and/or without bends and/or without coils, for example. Access to the extraction region of the milled-material conveying apparatus is made particularly easy through a maintenance tunnel of this kind, since the operator does not have to work around any bends. A pressure washer or its lance introduced through the maintenance tunnel, for example, can therefore be pushed forward into the extraction region of the milled-material conveying apparatus without difficulty. The corresponding extension therefore in particular relates to the inner space provided by the maintenance tunnel, through which an operator standing beside the ground milling machine can perform maintenance on the extraction region. Additionally or alternatively, it is possible for the maintenance tunnel to be designed such that the tunnel entrance opening is arranged to be vertically higher than the tunnel exit opening. In other words, the maintenance tunnel extends obliquely downwards from the outside of the ground milling machine to the extraction region of the milled-material conveying apparatus. The maintenance tunnel is therefore designed to slope towards the extraction region. This means that, for example, water coming from the cleaning of the extraction region or from a pressure washer also flows in the maintenance tunnel towards the extraction region instead of onto the operator towards the outside of the ground milling machine. In this way, the operator can easily clean the extraction region without running the risk of becoming soaked with water that flows back. In a likewise preferred alternative, it is provided that the maintenance tunnel extends horizontally. In other words, the tunnel entrance opening and the tunnel exit opening are arranged vertically at the same height. In this embodiment, long cleaning appliances, for example pressure washers, can be pushed through the maintenance tunnel particularly easily, since its extension is very intuitive. Furthermore, the maintenance tunnel preferably extends substantially perpendicularly to a steering axis of the ground milling machine or in parallel with a rotational axis of the milling drum. In the present case, "substantially perpendicularly" means that a deviation of up to 5° is considered insignificant. The steering axis of the ground milling machine is typically vertical, while the rotational axis of the milling drum is arranged horizontally and in particular transversely to the working direction. In other words, the horizontal extension of the maintenance tunnel oriented transversely to the working direction is a preferred embodiment.

Further preferred embodiments provide that the maintenance tunnel is designed such that its clear width from one of the side walls or the front wall or rear wall of the ground milling machine remains constant or decreases or increases up to the extraction opening or the extraction hood. The free space provided by the maintenance tunnel from the outside to the extraction region therefore remains the same or decreases or increases between the tunnel entrance opening and the tunnel exit opening. A constant clear width, i.e. a constant free space, is particularly intuitive and easy to clean, and is also easy to produce. If the clear width decreases up to the extraction region, the tunnel exit opening is smaller than the tunnel entrance opening, in particular in diameter. During operation of the milled-material conveying apparatus and the dust extraction apparatus, less dust is therefore introduced into the maintenance tunnel through the tunnel exit opening, and therefore the tunnel becomes dirty or even blocked to a lesser extent. If the clear width increases, the tunnel exit opening is larger than the tunnel entrance opening. In this case, although more dirt can be introduced through the tunnel exit opening into the maintenance tunnel, if anything, the blockages are comparatively easy to remove, since the free space in the maintenance tunnel increases towards the extraction region and blockages can therefore be particularly easily pressed out of the maintenance tunnel in this direction.

It is preferable for the contour of the tunnel entrance opening and the contour of the tunnel exit opening to be identical to one another, in particular circular. The contour describes the shape of the relevant opening or the shape of the rim of the opening.

A water tank is typically arranged in the region of the dust extraction apparatus in generic ground milling machines. In order to then have to reduce the size of the water tank as little as possible and to fully utilize the installation space, part of the dust extraction apparatus, for example the extraction line and the extraction hood, extends through the water tank at least in part, for example in the form of one or more pipelines and/or pipeline portions. To further advance this concept, it is preferable for the maintenance tunnel to also extend through a water tank of the ground milling machine at least in part. In doing so, the additional arrangement of the maintenance tunnel reduces the capacity of the water tank only to a minimal extent.

Maintenance has to be regularly performed on generic ground milling machines. To do this, it may be necessary to give access to the milling drum in the milling-drum housing in order to change the milling tools, for example, if they have reached their wear limits and/or are defective. For this purpose, it may be provided that the ground milling machine is brought into a maintenance position. This may for example be defined by the machine frame comprising lifting columns that connect travel apparatuses being extended and the machine frame therefore being raised far enough that the milling drum is not in engagement with the ground and can rotate freely or at least is resting on the unmilled surface of the ground. Since the ground milling machine is therefore typically in the maintenance position during maintenance work, it is advantageous for the maintenance tunnel to be positioned with its tunnel entrance opening at such a height, when viewed from the ground, that it can be reached, in the maintenance position of the ground milling machine, by a person of average height standing beside the machine using a cleaning apparatus, for example a lance of a pressure washer. Specifically, it has proven optimal here for the maintenance tunnel to be located with its tunnel entrance opening, in a maintenance position and/or in a position in which the milling drum is resting on the unmilled surface of the ground, at a height of at most 2 m, preferably at most 1.7 m, in particular at most 1.6 m, vertically above the ground. Additionally or alternatively, it is likewise advantageous for the tunnel entrance opening to be positioned at a height on the ground milling machine such that, in a maintenance position of the ground milling machine and/or in a position of the ground milling machine in which the milling drum is resting on the unmilled surface of the ground, it is located at a height of at least 0.5 m, in particular at least 0.9 m, above the surface of the ground. In this way, the maintenance tunnel, in particular the tunnel entrance opening of the maintenance tunnel, can be reached particularly easily and comfortably by an operator who is standing on the ground beside the ground milling machine. This operator can carry out the necessary work in the extraction region of the dust extraction apparatus without having to climb on the ground milling machine.

So that the full suction power of the dust extraction apparatus can be utilized for actually removing dust-containing air from the extraction region, it is preferable for the maintenance tunnel, in particular all the maintenance tunnels, to be closed during the work operation of the ground milling machine, such that air is prevented from being drawn in from the external environment through at least one maintenance tunnel. A configuration of the maintenance tunnel as intended therefore provides that it is closed during the milling operation of the ground milling machine, in particular that it is closed in a substantially airtight manner. The maintenance tunnel therefore does not perform any additional functions during the milling operation, but instead is merely used for cleaning the extraction region during maintenance work or breaks in operation. The maintenance tunnel is therefore a separate tunnel that is not provided on conventional machines. In particular, the maintenance tunnel extends separately from cut-outs in the interior of the machine through which conveying apparatuses and the milled material and exhaust air are conveyed. In principle, suitable closure elements, such as removable closure flaps or the like, can be used for this purpose, for example. It is, however, preferable for the closure element of the maintenance tunnel to be mounted such that it can be moved between an open position and a closed position, in particular manually from outside the ground milling machine. In both positions, the closure element thus remains connected to the rest of the machine and is therefore mounted such that it cannot be lost. The closure element may be a closure cover or maintenance cover, for example. This is preferably designed such that, in the closed position, it closes the maintenance tunnel, preferably in the region of the tunnel entrance opening and/or on the side wall, the front wall or the rear wall of the ground milling machine, at least substantially in an airtight manner. Furthermore, the maintenance cover may preferably comprise a locking device, which locks the maintenance cover in the closed position. This may for example be produced in the manner of a tank cap by means of a thread and/or a closable lock, a latching apparatus or the like.

It is also possible to develop the maintenance cover comprising a plug such that the plug closes the tunnel exit opening from the extraction opening or extraction hood when the maintenance cover closes the maintenance tunnel on the side wall, the front wall or the rear wall of the ground milling machine. In other words, the maintenance cover is connected to a plug which closes the tunnel exit opening coming from the tunnel entrance opening when the maintenance cover is in the closed position. The maintenance cover and the plug may for example be formed in one piece as a cylindrical body which completely fills the inner space of the maintenance tunnel from the tunnel entrance opening to the tunnel exit opening. Other embodiments are, however, also conceivable, for example a disc-shaped cover which is connected by a rod to another disc-shaped cover designed as a plug. The specific shape of the maintenance cover and the plug is of course determined by the corresponding shape of the maintenance tunnel and/or of the tunnel entrance opening and tunnel exit opening. Particularly preferably, the plug closes the tunnel exit opening so as to be flush with the extraction line or extraction hood. When the maintenance cover is in the closed position, the plug closes the tunnel exit opening, with the plug in particular being arranged in the maintenance tunnel without any excess projecting. In other words, the plug does not project out of the maintenance tunnel into the extraction line or extraction hood. This prevents the flow conditions within the extraction line and/or extraction hood from being altered by the maintenance tunnel being provided. By closing the tunnel exit opening with the plug, in particular closing it in a flush manner, the inner wall of the extraction line or extraction hood is reproduced as if no maintenance tunnel were provided. In this way, the function of the dust extraction apparatus is not impaired by the maintenance tunnel. Furthermore, dirt is prevented from being introduced into the maintenance tunnel through the tunnel exit opening. Therefore, the maintenance tunnel cannot become either dirty or clogged during the work operation of the ground milling machine. As a result, the maintenance tunnel does not need to be cleaned, and therefore the maintenance complexity is kept as low as possible overall.

In order to ensure that, as far as possible, the ground milling machine, and in particular the dust extraction apparatus, is not operated when the maintenance cover is in the open position, it is preferably provided that a closure sensor is provided which is designed to determine whether the maintenance cover is in the closed position. Therefore, for example, it may be provided that an optical or acoustic warning is displayed to an operator on the driver's platform of the ground milling machine when the maintenance cover is in the open position. In this way, the operator knows that the maintenance cover still needs to be closed before the dust extraction apparatus is started up. To do this, the sensor may for example be connected to a controller of the ground milling machine, for example part of the on-board computer.

The object mentioned at the outset is likewise achieved by a method according to the invention. All the described features, effects and advantages of the ground milling machine apply, in the figurative sense, to the method. The same also applies in reverse: all the features, effects and advantages of the method equally apply to the ground milling machine. To avoid repetition, reference is merely made to the other configurations in each case.

Specifically, the object is achieved by a method for the maintenance of a dust extraction apparatus for extracting dust-containing air from a milled-material conveying apparatus of a ground milling machine, comprising the steps of: opening a maintenance tunnel which establishes an access connection between at least one extraction opening and/or extraction hood of the dust extraction apparatus and a side wall, a front wall or a rear wall of the ground milling machine; performing maintenance on, for example cleaning, the extraction line and/or the extraction hood and/or the extraction opening through the maintenance tunnel; and closing the maintenance tunnel on the side wall, the front wall or the rear wall of the ground milling machine. For the maintenance or cleaning work, it may for example be provided that a cleaning tool, for example a pressure washer, is inserted into or through the maintenance tunnel. For example, the pressure washer can be pushed into the extraction region of the dust extraction apparatus in order to be particularly efficiently guided to clean the extraction region. In the method according to the invention, it is essential for the cleaning to be carried out through the maintenance tunnel, which is arranged on one of the side walls, the front wall or the rear wall of the ground milling machine and is therefore very easily accessible to the operator. It is no longer necessary to climb onto the ground milling machine, with the associated risk of an accident.

Overall, for the method according to the invention, it is therefore preferable for said method to be carried out by an operator standing beside the ground milling machine. In this case, the operator stands on the ground beside the ground milling machine and does not have to climb thereon. As a result, the maintenance or cleaning of the extraction region of the dust extraction apparatus is made faster and easier, meaning that the cost-effectiveness of the operation of the ground milling machine is increased.

BRIEF DESCRIPTION OF THE DRAWINGS

The invention will be explained in greater detail in the following with reference to the embodiments shown in the drawings, in which, schematically:

FIG. 3 is a perspective oblique view of part of the machine frame and the dust extraction apparatus of a ground milling machine from behind and from above;

FIG. 4 shows a maintenance cover comprising a plug;

DETAILED DESCRIPTION

Figure 1:
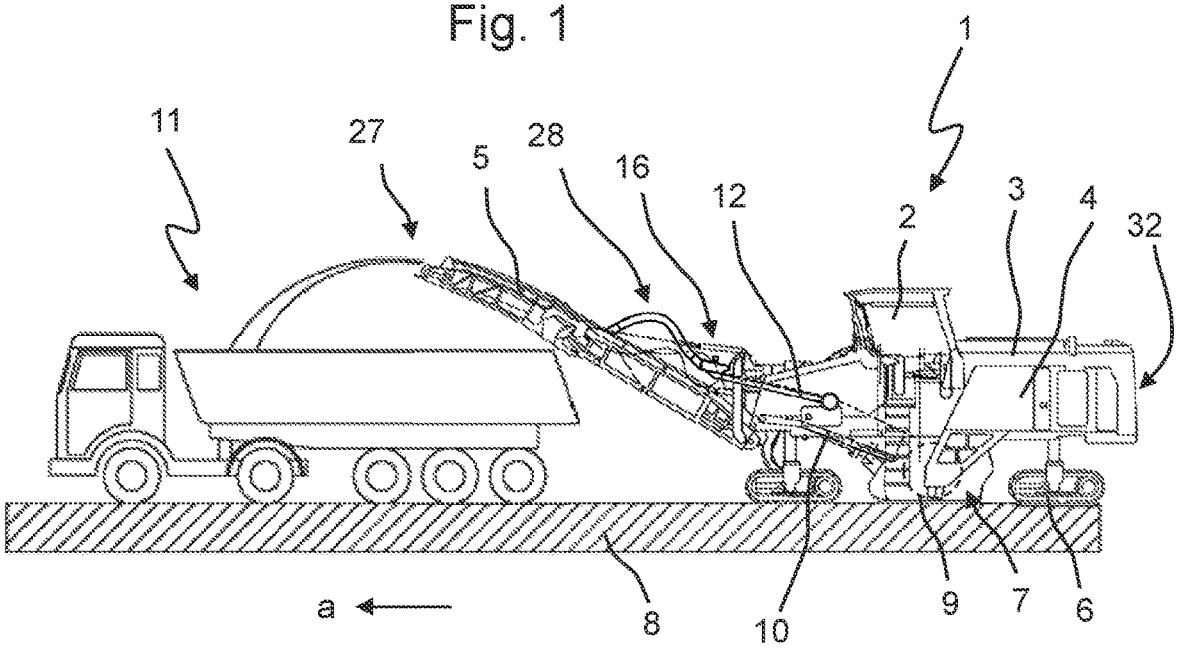
FIG. 1 is a side view of a ground milling machine in a work train with a transport vehicle.

Identical or identically functioning components are denoted by identical reference signs in the drawings. Repeated components are not denoted separately in each figure.

FIG. 1 shows a work train comprising a ground milling machine 1, in this case a road milling machine, and a transport vehicle 11, specifically a truck. The ground milling machine 1 is shown again in FIG. 2 in an enlarged manner. It comprises a machine frame 3 comprising a driver's platform 2. The machine frame 3 is supported by travel apparatuses 6, which are crawler tracks in the embodiment shown, but could also be wheels. The travel apparatuses 6 are mounted on the machine frame 3 by height-adjustable lifting columns 14. For powering, the ground milling machine 1 comprises an engine 4, which is typically a diesel internal combustion engine. The ground milling machine 1 comprises a milling drum 9, which is rotatably mounted in a milling-drum housing 7. The milling drum 9 is equipped with milling tools and mills off ground material from the ground 8 by rotating during the work operation of the ground milling machine 1. In this process, the ground milling machine 1 moves in or counter to the working direction a. In the embodiment shown, the milled-off ground material is loaded from the milling-drum housing 7 forwards in the working direction a onto the transport vehicle 11 by means of a milled-material conveying apparatus 28. The milled-material conveying apparatus 28 comprises two separate conveying apparatuses. A loading conveying apparatus 10, which receives the milled material from the milling-drum housing 7 and conveys it forwards through the machine frame 3 at least in part in the working direction a, is located in the interior of the machine. At the end of the machine frame 3 at the front in the working direction a, the loading conveying apparatus 10 then loads the milled material onto a discharge conveying apparatus 5 attached to the machine frame 3. The discharge conveying apparatus 5 then transports the milled material further towards the transport vehicle 11 and vertically upwards as far as a discharge point 27, from which the milled material is discharged onto the transport bed of the transport vehicle 11. The loading conveying apparatus 10 and the discharge conveying apparatus 5 are designed as conveyor belts, for example. It is also possible for the milled-material conveying apparatus 28 to only comprise one single transport conveyor belt. The present embodiment also shows a ground milling machine 1 comprising a milling-drum housing 7 positioned between the front and the rear travel apparatuses 6, when viewed in the working direction, at a distance therefrom in the working direction a in each case. Ground milling machines 1 of this kind are also called central rotor milling machines. However, the invention also equally relates to ground milling machines in which the milling-drum housing 7 is positioned at the rear, specifically between the two rear travel apparatuses 6, i.e. what are known as rear rotor milling machines. It is also not necessary, although it is preferred, for all the travel apparatuses 6 to each be connected to the machine frame 3 by a height-adjustable lifting apparatus, for example lifting columns 14.

Figure 2:
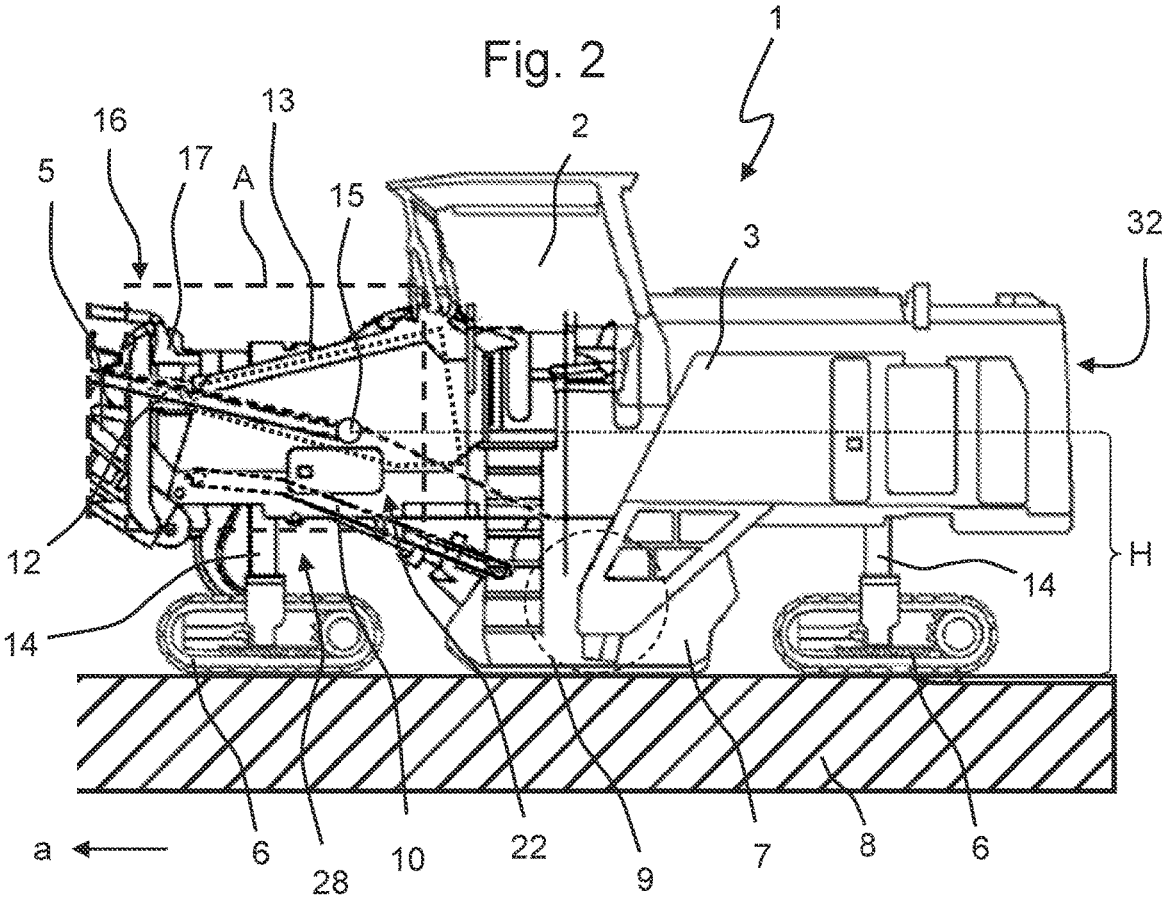
FIG. 2 is an enlarged side view of the ground milling machine according to FIG. 1.

In order to prevent dust-polluted air from being output into the external environment around the ground milling machine 1 as far as possible or to at least considerably reduce this, the ground milling machine 1 comprises a dust extraction apparatus 16. This may for example be designed in the same way as in the prior art mentioned at the outset. It may comprise a fan or another extraction apparatus, by means of which the dust-polluted air is extracted from a region of the milled-material conveying apparatus 28 via at least one extraction line 12. This region is characterized in that it constitutes a space through which the milled-material conveying apparatus 28 passes in part and in which dust-polluted air develops during the milling operation of the ground milling machine 1. Usually, this region is therefore a region adjoining the milling-drum housing in the conveying direction of the milled material. The region relevant for the dust extraction here is also in the interior of the ground milling machine 1 itself or in a part of the machine through which the loading conveying apparatus 10 passes, and not in the region of the outer conveyor belt or the discharge conveying apparatus 5. In the embodiment shown, the dust extraction apparatus 16 extracts dust-polluted air in the region of the loading conveying apparatus 10, for example, specifically in the conveying shaft 22 of the loading conveying apparatus 10. The dust is then removed from this air or this air is merely fed back to the milled material in the region of the discharge conveying apparatus 5, for example. This alone makes it possible to reduce the dust pollution in the environment in the region of the ground milling machine 1. As shown in FIG. 2, the dust extraction apparatus 16 may extend through a water tank 13 of the ground milling machine 1 at least in part. In this way, the capacity of the water tank 13 is reduced as little as possible by the dust extraction apparatus 16.

Figure 5:
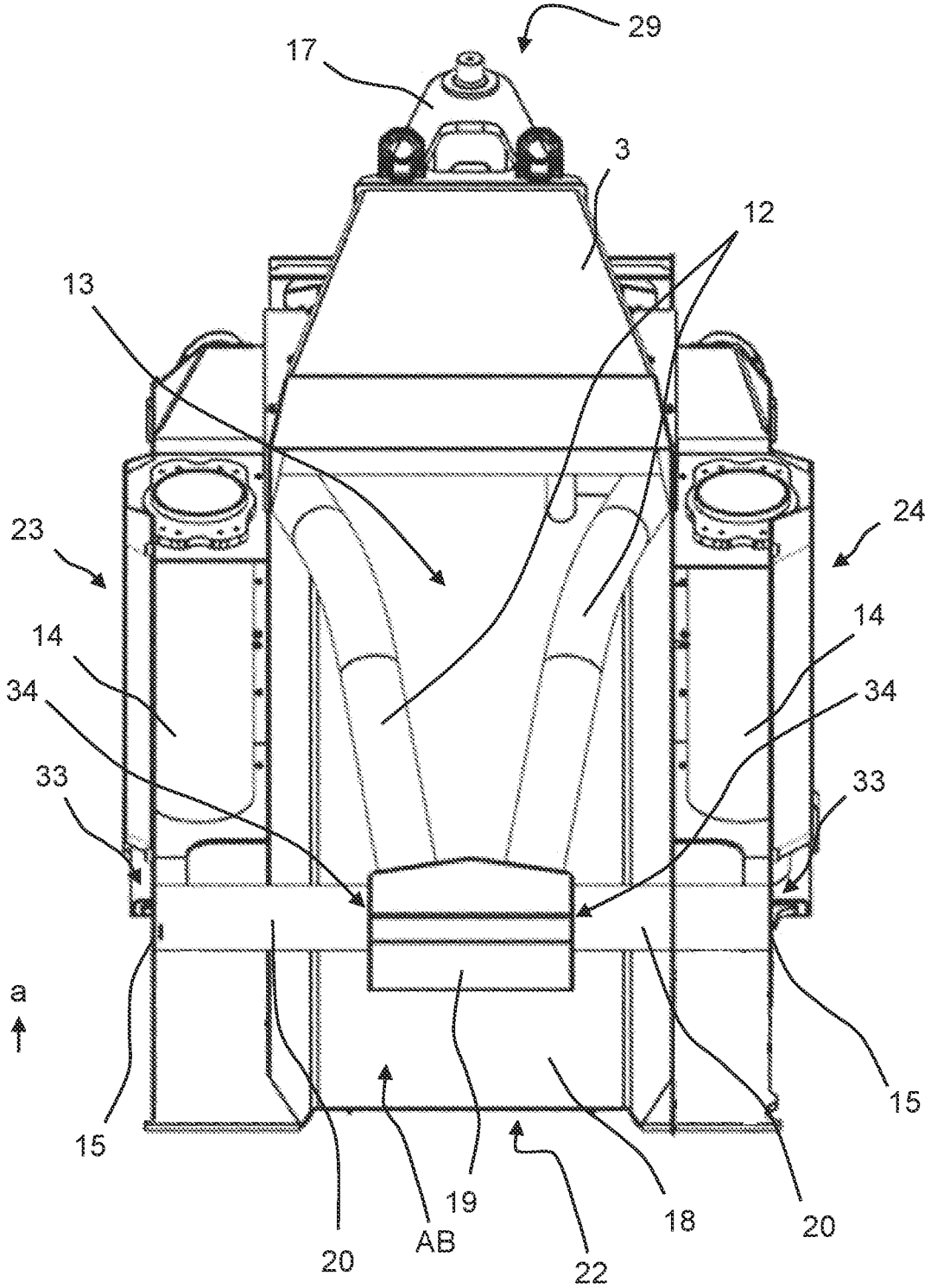
FIG. 5 is another perspective view according to FIG. 3 from behind.
Figure 6:
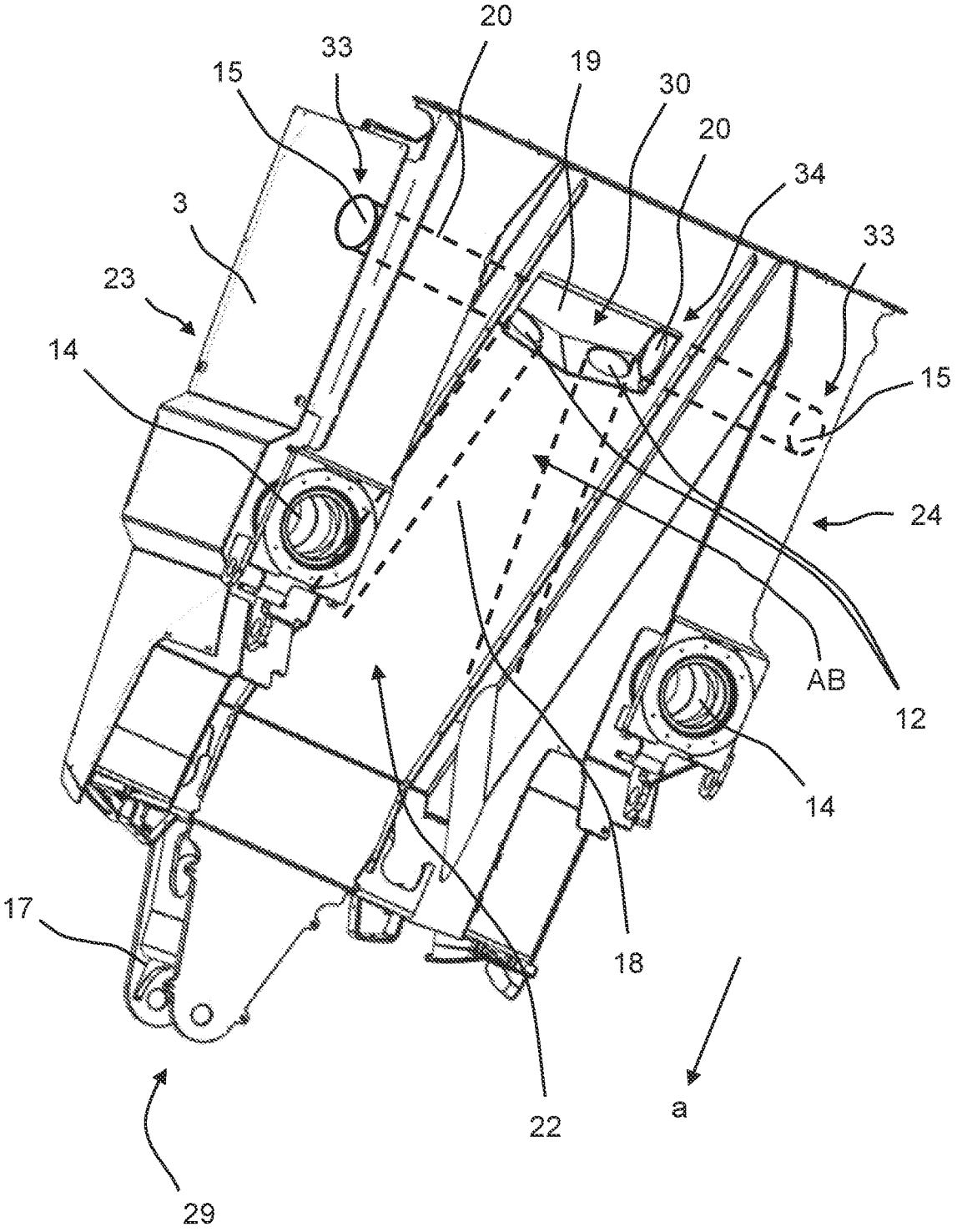
FIG. 6 is another perspective view according to FIG. 3 from below.

In particular, the region of the dust extraction apparatus 16 which opens into the region or conveying shaft 22 of the milled-material conveying apparatus 28, specifically the loading conveying apparatus 10, can become very dirty during operation, meaning that blockages may occur. This region is also called the extraction region AB. The extraction region AB is therefore in particular the region in which the extraction effect of the dust extraction occurs during operation. The extraction region AB may become blocked in particular in the region of the inlet openings of the extraction lines 12 (variants comprising just one extraction opening and/or one extraction line are also included here). By means of the maintenance tunnel 15, which is described in greater detail in the following, the invention provides the possibility of cleaning this extraction region AB more easily, as described in greater detail in the following, in particular with reference to FIGS. 3, 5 and 6. For this purpose, as shown in FIG. 2, the maintenance tunnel 15 is arranged on the ground milling machine 1 such that, in the maintenance position of the ground milling machine 1, it is at a height H that is easily accessible to an operator standing beside the ground milling machine 1. The height H denotes the vertical distance between the tunnel entrance opening 33 (see FIG. 3, for example) of the maintenance tunnel 15 and the ground 8.

FIG. 3 is an oblique perspective view from behind and from the left of the part of the ground milling machine 1 according to detail A from FIG. 2. Other parts of the ground milling machine 1 and parts of the machine frame 3 have been omitted for the sake of clarity. In particular, FIG. 3 shows the inner space in the water tank 13 through which two extraction lines 12 extend in the present embodiment. Both extraction lines 12 proceed forwards from an extraction hood 19 in the working direction a and open into continuing hose connections to the extraction apparatus in the front side of the machine frame. As shown in particular in the view from below according to FIG. 6, the extraction hood 19 is open vertically at the bottom, with a passage through the water-tank base 18 also being arranged here. Overall, the extraction opening 30 is therefore formed, which establishes a connection between the conveying shaft 22 of the loading conveying apparatus 10, which is below the water tank 13, and the extraction hood 19. Overall, the dust extraction apparatus 16 therefore extracts dust-polluted air from the conveying shaft 22 into the extraction hood 19 through the extraction opening 30 and, from there, extracts it into the extraction lines 12, from which the dust-polluted air is transported away. The extraction region therefore substantially comprises the extraction opening 30 and the extraction hood 19 as well as the inlets to the extraction lines 12. This region may become coated or blocked with dirt during the work operation of the ground milling machine 1. Until now, in the prior art, it was necessary to drain the water from the water tank 13 in order to perform maintenance on the extraction region and to then gain access to the extraction hood 19 from above through the service hatch 21 (see FIG. 3) or to crawl underneath the machine. The extraction hood 19 then had to be opened in order for it to be possible to carry out cleaning, for example. On one hand, a drawback of this is the high level of additional work involved in draining the water tank 13 and opening the extraction hood 19 as well as the service hatch 21. On the other hand, the service hatch 21 is only accessible from the top of the ground milling machine 1, which means that, to use it, an operator has to climb onto the machine, which is not only inconvenient, but can also be dangerous.

By contrast, the invention proposes providing at least one maintenance tunnel 20, through which the extraction region and in particular the extraction opening 30 is accessible to an operator standing on the unmilled surface of the ground beside the ground milling machine 1. In the specific embodiment, two maintenance tunnels 20 are provided, which open into the extraction hood 19 from opposite sides of the ground milling machine 1. In the present case, a distinction is made between four different sides of the ground milling machine 1 in total. All of these sides form the boundaries of the outer contour of the machine frame 3 and are accessible to an operator standing beside the ground milling machine 1 from the outside. Therefore, the ground milling machine 1 comprises a left side wall 23 and a right side wall 24, for example. The side walls 23, 24 form the left and right lateral boundary of the ground milling machine 1 and extend substantially vertically and in parallel with the working direction a, and they may likewise contain curves or steps. Furthermore, the ground milling machine 1 comprises a front wall 29. The front wall 29 is the wall at the front end of the machine frame 3 in the working direction. A conveying apparatus arranged further forwards in the working direction a, i.e. the discharge conveying apparatus 5 in the embodiment shown, is not seen here. The support 17 for the discharge conveying apparatus 5 is therefore likewise arranged on the front wall 29 of the ground milling machine 1. In addition, the ground milling machine 1 of course likewise comprises a rear wall 32 (see FIGS. 1 and 2), which forms the boundary of the machine frame 3 at the rear in the working direction a. The front wall 29 and the rear wall 32 are oriented substantially vertically and transversely to the working direction a. In principle, the maintenance tunnel 20 according to the invention could then be arranged on each of said sides, i.e. the left side wall 23, the right side wall 24, the front wall 29 or the rear wall 32. In the embodiment shown in the drawings, a total of two maintenance tunnels 20 are provided, with one maintenance tunnel 20 being arranged on the left side wall 23 and one maintenance tunnel 20 being arranged on the right side wall 24.

A maintenance tunnel 20 according to the invention comprises a tunnel entrance opening 33 and a tunnel exit opening 34. The tunnel exit opening 34 establishes the connection between the inner space in the maintenance tunnel 20 and the extraction hood 19. In the embodiment shown, the tunnel exit openings 34 of the two maintenance tunnels 20 are on opposite sides of the extraction hood 19, meaning that they are particularly easily accessible. The tunnel entrance opening 33 in turn connects the inner space in the maintenance tunnel 20 to the external environment around the ground milling machine 1. Therefore, the tunnel entrance openings 33 of the two maintenance tunnels 20 in the embodiment shown are arranged on the left side wall 23 and the right side wall 24, respectively. The maintenance tunnel 20 extends between the tunnel entrance opening 33 and the tunnel exit opening 34 in a straight line with a constant clear width. In the same way as the extraction lines 12, the maintenance tunnels 20 extend through the inner space in the water tank 13, in order to limit the volume thereof less significantly than would be the case if an indentation were formed in the water tank 13. An operator standing beside the ground milling machine 1 can easily use the access to the extraction hood 19 through the maintenance tunnels 20 for maintenance or cleaning work. For example, a maintenance tool, for example a pressure washer, can be inserted through the maintenance tunnels 20 as far as the extraction region, for example the extraction hood 19. Stubborn blockages in the extraction region can also be removed in this way.

To avoid that the dust extraction apparatus 16 draws in air through the maintenance tunnels 20, which would mean that the extraction power was reduced in the region of the milled-material conveying apparatus 28, a maintenance cover 15 is provided, which can cover the maintenance tunnels 20 at least at their tunnel entrance openings 33. The maintenance cover 15 is fastened to the machine frame 3 in a hinged manner, for example, such that it can be moved between an open position, in which it opens the tunnel entrance opening 33, and a closed position, in which it closes the tunnel entrance opening 33. In particular, the maintenance cover 15 is formed such that it closes the tunnel entrance opening 33 in an airtight manner. In this way, it is ensured that the dust extraction apparatus 16 operates properly.

FIG. 4 shows a possible complete closure for the maintenance tunnel 20. FIG. 4 shows a closure element 25, the shape of which is adapted to the inner space in the maintenance tunnel 20. The closure element 25 likewise comprises the maintenance cover 15 and also comprises a plug 26. The plug 26 is in particular designed such that it closes the tunnel exit opening 34 of the maintenance tunnel 20, in particular at least substantially in an airtight manner, when the closure element 25 is inserted into the maintenance tunnel 20. At the same time, the maintenance cover 15, which the closure element 25 also comprises, closes the tunnel entrance opening 33 in this position. The closure element 25 therefore comprises both the maintenance cover 15 and the plug 26, which are interconnected. This does not have to be produced by the cylindrical configuration shown in FIG. 4, but instead different designs can also be used. It is only important that the closure element 25 together with the maintenance cover 15 closes the tunnel entrance opening 23 and simultaneously the tunnel exit opening 34 by means of the plug 26. In this closed position of the closure element 25, the plug 26 is in particular arranged so as to be flush with the extraction hood 19. This means that the plug 26 does not project or protrude into the extraction hood 19. In this way, the flow conditions in the extraction hood 19 are not influenced by the plug 26. At the same time, any influence through the maintenance tunnel 20 via the tunnel exit opening 34 is likewise prevented. Overall, when the closure element 25 is closed, the same flow conditions therefore prevail in the extraction hood 19 that would prevail without the maintenance tunnel 20. At the same time, dirt is prevented from penetrating into the maintenance tunnel 20 via the tunnel exit opening 34.

The closure element 25 and/or the maintenance cover 15 may likewise comprise a locking element 31, by means of which the closure element 25 and/or the maintenance cover 15 can be held in the closed position. For example, the locking element 31 may be a thread and/or a lock.

In order to prevent the dust extraction apparatus 16 from being operated when one of the maintenance tunnels 20 is open, according to a preferred embodiment, it is possible that a closure sensor 35 is provided. In particular, a separate closure sensor 35 is provided for each maintenance tunnel 20. The closure sensor 35 detects whether or not the maintenance cover 15 or closure element 25 is in the closed position. If all the maintenance covers 15 or closure elements 25 are not in the closed position, a warning can be displayed to the operator on the driver's platform 2 of the ground milling machine 1. For this purpose, the closure sensors 35 are connected to a control unit of the ground milling machine 1 or the on-board computer thereof. Additionally or alternatively, it may also be provided that the dust extraction apparatus 16 can only be operated when all the maintenance covers 15 or closure elements 25 are in the closed position and the maintenance tunnels 20 are closed.

Figure 7:
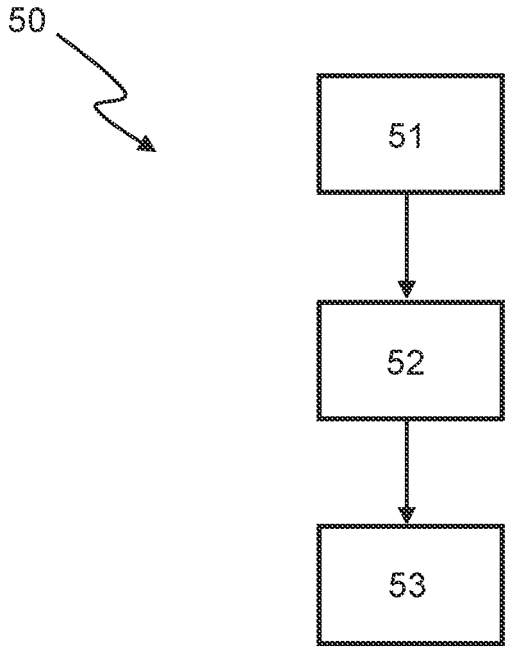
FIG. 7 is a flow diagram of the method.

FIG. 7 is a flow diagram of the method 50 according to the invention. The method 50 begins by opening 51 a maintenance tunnel 20, for example by opening a maintenance cover 15 or by removing a closure element 25 from the maintenance tunnel 20. The maintenance tunnel 20 then opens an access connection between the outside of the ground milling machine 1, for example one of the side walls 23, 24, the front wall 29 or the rear wall 32 of the ground milling machine 1, and the extraction region of the dust extraction apparatus 16. Next, maintenance 52 or cleaning of the extraction region can therefore be carried out through the maintenance tunnel 20. This can preferably be performed easily by an operator standing on the ground 8 beside the ground milling machine 1, since the maintenance tunnels 20 are arranged vertically above the ground 8 at a height that is easy to reach. For example, a blockage in the extraction region, for example the extraction opening, can be flushed free using a maintenance tool such as a pressure washer. Finally, the maintenance tunnel 20 is then closed 53 on the relevant side of the ground milling machine. Here, in particular the maintenance cover 15 and/or the closure element 25 are brought into the closed position, meaning that the tunnel entrance opening 33 and/or the tunnel exit opening 34 are closed in an airtight manner Overall, the invention therefore greatly simplifies the cleaning of the extraction region of the dust extraction apparatus 16 of the ground milling machine 1, meaning that both the safety and comfort of the operator and the cost-effectiveness of the work operation of the ground milling machine 1 are improved.

What is claimed is:

1. A ground milling machine for machining ground in, or counter to, a working direction, comprising:

a machine frame, supported by travel apparatuses, comprising a drive engine;

a milling drum, rotatably mounted in a milling-drum housing arranged on the machine frame, for removing ground material;

a milled-material conveying apparatus for transporting the removed ground material from the milling-drum housing to a discharge point; and a dust extraction apparatus for extracting dust-containing air from a region of the milled-material conveying apparatus, wherein the dust extraction apparatus comprises at least one extraction line, which opens into the region of the milled-material conveying apparatus via an extraction opening, wherein the ground milling machine comprises a left side wall, a right side wall, a front wall and a rear wall, wherein a maintenance tunnel is provided which comprises a tunnel entrance opening and a tunnel exit opening and is configured such that, via the tunnel entrance opening, the maintenance tunnel establishes an access connection, accessible from outside the ground milling machine, between one of the left side wall, the right side wall, the front wall or the rear wall of the ground milling machine and the extraction opening; and wherein the left side wall, the right side wall, the front wall and the rear wall are each outer walls of the ground milling machine.

2. The ground milling machine according to claim 1, wherein the dust extraction apparatus comprises an extraction hood which is open towards the region of the milled-material conveying apparatus, comprises the extraction opening arranged in the region of the milled-material conveying apparatus and into which both the extraction line and the maintenance tunnel open.

3. The ground milling machine according to claim 1, wherein two maintenance tunnels are provided, wherein the second maintenance tunnel establishes an access connection between the extraction opening and an additional one of the left side wall, the right side wall, the front wall or the rear wall.

4. The ground milling machine according to claim 3, wherein one of the two maintenance tunnels is arranged with its tunnel entrance opening on the left side wall and the other of the two maintenance tunnels is arranged with its tunnel entrance opening on the right side wall, and wherein the two maintenance tunnels open into the extraction opening.

5. The ground milling machine according to claim 4, wherein the two maintenance tunnels open into the extraction opening, in an extraction hood.

6. The ground milling machine according to claim 5, wherein the two maintenance tunnels open into the extraction opening, in the extraction hood, opposite one another.

7. The ground milling machine according to claim 1, wherein the maintenance tunnel has at least one of the following features:

the maintenance tunnel extends in a straight line and/or without bends and/or without coils;

the maintenance tunnel is configured such that the tunnel entrance opening is arranged to be vertically higher than the tunnel exit opening;

the maintenance tunnel extends horizontally;

the maintenance tunnel is configured such that its clear width from the left side wall, the right side wall, the front wall or the rear wall of the ground milling machine remains constant or decreases or increases up to the extraction opening or an extraction hood;

the maintenance tunnel extends through a water tank of the ground milling machine at least in part;

the maintenance tunnel extends substantially perpendicularly to a steering axis of the ground milling machine or in parallel with a rotational axis of the milling drum;

the maintenance tunnel is arranged on the ground milling machine such that, when the ground milling machine is in a maintenance position, the maintenance tunnel is located at most 2 m vertically above the ground.

8. The ground milling machine according to claim 7, wherein the maintenance tunnel is arranged on the ground milling machine such that, when the ground milling machine is in the maintenance position, the maintenance tunnel is located at most 1.5 m vertically above the ground.

9. The ground milling machine according to claim 1, wherein on a side of the maintenance tunnel arranged to face away from the extraction opening, a maintenance cover is movable between an open position and a closed position is provided, which cover is configured such that the cover can close the maintenance tunnel on the left side wall, the right side wall, the front wall or the rear wall of the ground milling machine.

10. The ground milling machine according to claim 9, wherein the maintenance cover is connected to a plug such that the plug closes the tunnel exit opening between the extraction opening or an extraction hood and the maintenance tunnel when the maintenance cover closes the maintenance tunnel on the left side wall, the right side wall, the front wall or the rear wall of the ground milling machine.

11. The ground milling machine according to claim 9, wherein a closure sensor is provided which is configured to determine whether the maintenance cover is in the closed position.

12. A method for the maintenance of the dust extraction apparatus for extracting dust-containing air from the milled-material conveying apparatus of the ground milling machine, according to claim 1, comprising the steps of:

a) opening the maintenance tunnel which establishes the access connection between the extraction opening and/or an extraction hood of the dust extraction apparatus and the left side wall, the right side wall, the front wall or the rear wall of the ground milling machine;

b) performing maintenance on the at least one extraction line and/or the extraction hood and/or the extraction opening through the maintenance tunnel; and c) closing the maintenance tunnel on the left side wall, the right side wall, the front wall or the rear wall of the ground milling machine.

13. The method according to claim 12, wherein the method is carried out by an operator standing beside the ground milling machine.

14. The ground milling machine according to claim 1, wherein the ground milling machine is a road milling machine, a recycler or a stabilizer.

15. The ground milling machine according to claim 1, wherein the maintenance tunnel extends between the tunnel entrance opening and the tunnel exit opening.

16. The ground milling machine according to claim 1, wherein the maintenance tunnel comprises at least one wall portion extending around a longitudinal tunnel axis.

17. The ground milling machine according to claim 1, wherein the maintenance tunnel is formed as an elongate cavity.

* * * * *